US005328773A

United States Patent [19]

Scott

[11] Patent Number: 5,328,773

[45] Date of Patent: Jul. 12, 1994

[54] ARTICLE OF MANUFACTURING USING A POWDERED METAL COMPONENT

[75] Inventor: Norm Scott, St. Thomas, Canada

[73] Assignee: ICM/Krebsoge, Livonia, Mich.

[21] Appl. No.: 940,037

[22] Filed: Sep. 3, 1992

[51] Int. Cl.[5] ..... B25G 3/28

[52] U.S. Cl. ..... 428/553; 285/382; 285/222; 403/14; 403/278; 403/279; 403/282

[58] Field of Search ..... 285/382, 222, 422; 403/13, 14, 278, 279, 282; 29/509, 512, 513, 892, 892.1, 892.11; 428/553, 548

[56] References Cited

U.S. PATENT DOCUMENTS

| | | | |
|---|---|---|---|
| 2,656,730 | 12/1949 | Mitchel | 29/512 |
| 3,007,603 | 11/1959 | Krehl | 29/512 |
| 3,894,331 | 7/1975 | Ragettli | 29/512 |
| 4,056,014 | 11/1977 | Kraft | 29/892 |

*Primary Examiner*—Donald P. Walsh
*Assistant Examiner*—Anthony R. Chi
*Attorney, Agent, or Firm*—Gifford, Groh, Sprinkle, Patmore and Anderson

[57] ABSTRACT

An article of manufacture is disclosed having a first part constructed or powdered metal and having a lip which extends outwardly from one end of the first part. A second part, for example a steel stamping, has a first side, a second side and an opening extending between its sides. The opening is dimensioned so that, with the second part positioned on the end of the first part, the lip extends through the opening and outwardly from the second or outer side of the second part. The first and second parts are then mechanically secured together by deforming the lip so that a portion of lip overlies and entraps an edge portion of the second part between the deformed lip and the end of the first part.

14 Claims, 2 Drawing Sheets

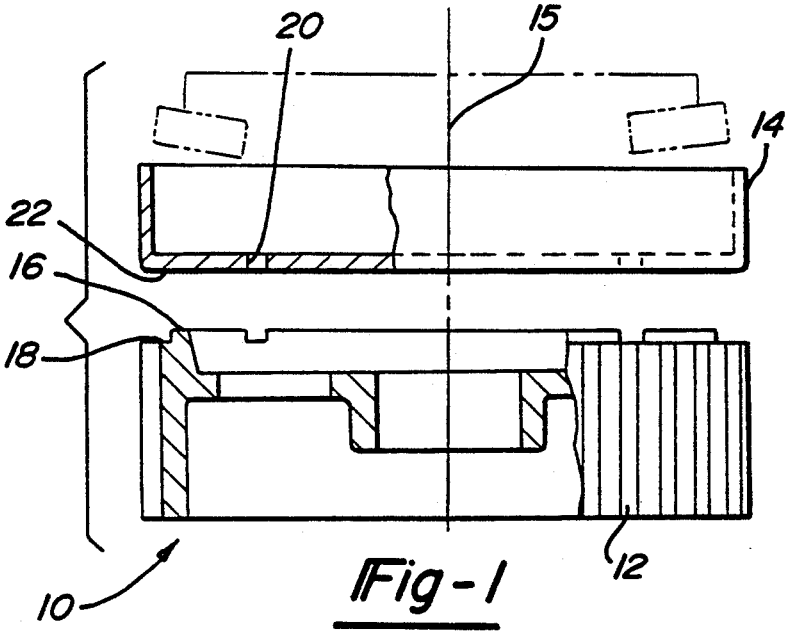
Fig-1
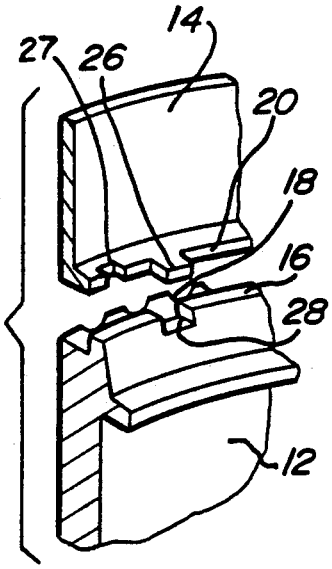
Fig-2
Fig-3
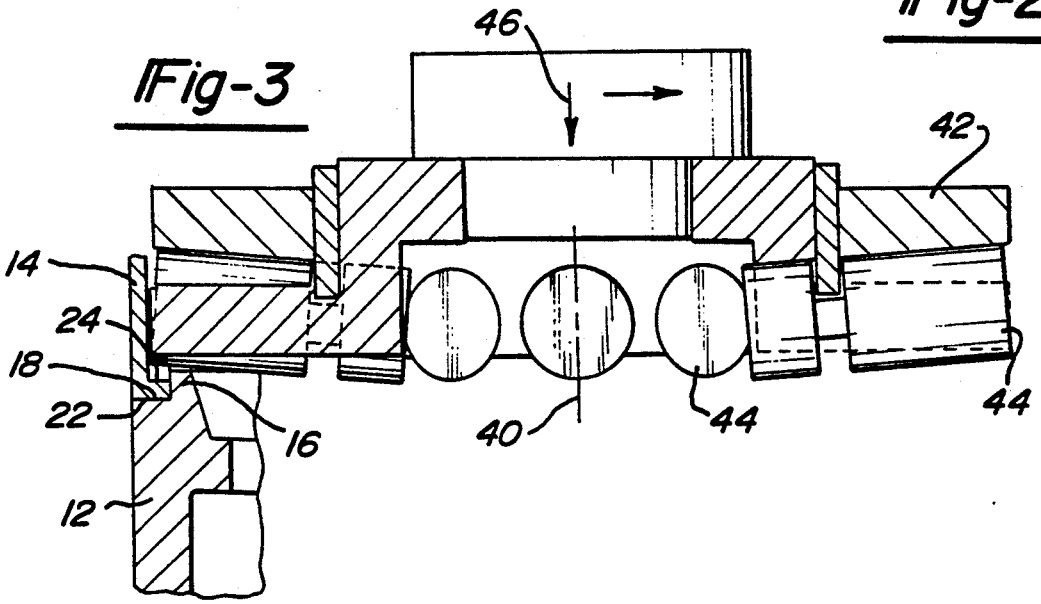
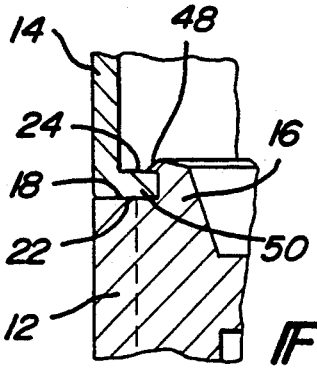
Fig-4
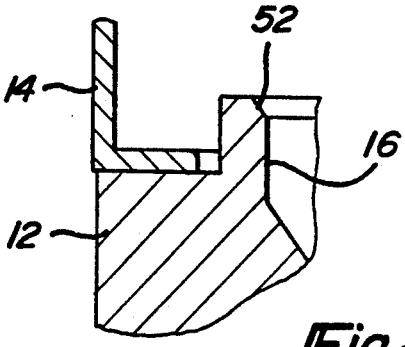
Fig-7

ARTICLE OF MANUFACTURING USING A POWDERED METAL COMPONENT

BACKGROUND OF THE INVENTION

I. Field of the Invention

The present invention relates to an article of manufacture having a powdered metal part which is mechanically secured to a second part by mechanical deformation of a lip on the first part.

II. Description of the Prior Art

Components manufactured from powdered metal have enjoyed increased popularity in industry for a number of reasons. One principle reason, however, is that complex shapes can be relatively inexpensively manufactured with powdered metal components as opposed to machining the component from standard metals. Furthermore, powdered metal components minimize the amount wastage of material in sharp contrast to machining operations of conventional metal.

Even though powdered metal components can be manufactured in complex configurations, in many situations it is necessary to mechanically secure a powdered metal part to a second part, typically constituted of standard metal. For example, in automotive applications, the main body of a pulley is oftentimes constructed from powdered metal. Thereafter, an annular belt retainer constructed from a metal stamping must be secured to one end of the main body. Furthermore, due to the shape of the main body when assembled to the belt retainer, it is not possible to manufacture the belt retainer and main body as a single powdered metal component.

There have been several different previously known ways for mechanically securing a powdered metal part to a non-powdered metal part. One such method has been to weld the parts together. This method, however, is only effective where the powdered metal part, or at least the portion which is to be welded to the other part, has a low carbon content. Otherwise, the carbon content of the powdered metal part precludes welding the parts together.

Still a further method of securing the powdered metal part and non-powdered metal part together has been to assemble the part together and then stake the junction in between the parts. In doing so, the deformation of the non-powdered metal part caused by the staking operation attaches the parts together. Such staking, however, creates a relatively weak mechanical bond between the powdered metal and non-powdered metal part so that even a relatively axial force between the parts is sufficient to separate them. This is particularly true for large components.

SUMMARY OF THE PRESENT INVENTION

The present invention overcomes all the above-mentioned disadvantages of the previously known devices and methods.

In brief, the present invention comprises a first part constructed of powdered metal and having a lip which extends outwardly from one end. A second part, typically constructed of a non-powdered metal material such as stamped steel, has both a first side, a second side and an opening extending between the sides of the second part. This opening is dimensioned so that, with the first side of the part positioned in abutment with the end of the first part, the lip extends through the opening and protrudes outwardly from the second side of the second part.

Thereafter, the first and second parts are mechanically secured together by deforming the lip so that a distal portion of the lip overlies and entraps an edge portion of the second part between the deformed portion of the lip and the end of the first part. Furthermore, this deformation is preferably accomplished by rolling the lip over the second or outer side of the second part. Additionally, the stamped second part may include cut outs at the rolled interface to increase the torque strength in the joint.

BRIEF DESCRIPTION OF THE DRAWING

A better understanding of the present invention will be had upon reference of the following detailed description, when read in conjunction with the accompanying drawing, wherein like reference parts refer to like parts throughout the several views, and in which:

FIG. 1 is an exploded side view illustrating a preferred embodiment of the present invention;

FIG. 2 is a fragmentary exploded elevational view illustrating a preferred embodiment of the present invention;

FIG. 3 is a fragmentary longitudinal sectional view illustrating one step of the present invention;

FIG. 4 is a fragmentary sectional view illustrating the preferred embodiment of the present invention;

FIG. 7 is an exploded view similar to FIG. 4 but illustrating an modification of the present invention.

DETAILED DESCRIPTION OF A PREFERRED EMBODIMENT OF THE PRESENT INVENTION

Figure 5:
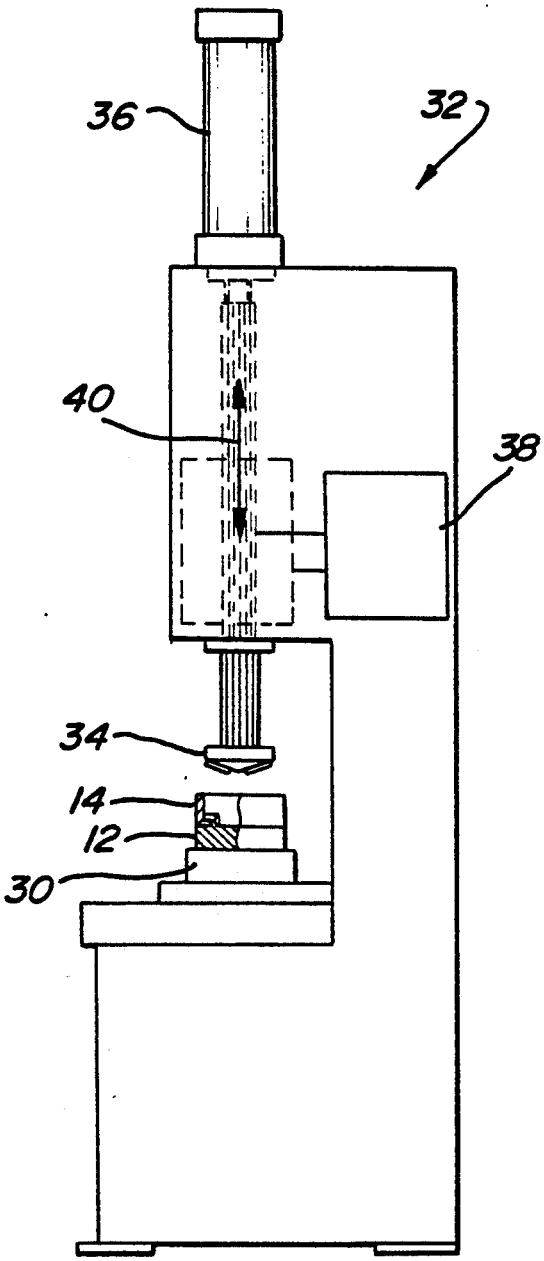
FIGS. 5 and 6 are side views illustrating the manufacture of the article of the present invention.

With reference first to FIGS. 1 and 2, a preferred embodiment of the present invention is there shown as a pulley 10 having a main body part 12 which is constructed from powdered metal and second part 14 which is constructed from a material other than powdered metal, such as a metal stamping. Both parts 12 and 14 are annular in construction and are arranged in axial alignment with each other about an axis 15.

The powdered metal part 12 includes an annular lip 16 which protrudes axially outwardly from one end 18 of the powdered metal part 12. This lip 16 registers with an opening 20 formed in the stamped metal part 14 so that, with the lip 16 positioned through the opening 20, a lower side 22 of the stamped metal part 14 abuts against the end 18 of the powdered metal part 12. Furthermore, as best shown in FIG. 3, with the stamped metal part 14 mounted on the powdered metal part 12, the lip 16 is axially dimensioned so that the lip 16 protrudes outwardly from a second or outer side 24 of the stamped metal part 14.

With reference now particularly to FIG. 2, if desired, the stamped metal part 14 may include a locating tab 26 which registers with a notch 28 in the powdered metal part 12. The tab 26 and notch 28 ensure that a predetermined angular orientation is maintained between the parts 12 and 14, when desired. Furthermore, the part 14 may include cut outs 27 for a reason subsequently described. One such situation, for example, where angular orientation between the parts 12 and 14 is necessary would be where one or both of the parts include timing notches used in internal combustion engines.

Figure 6:
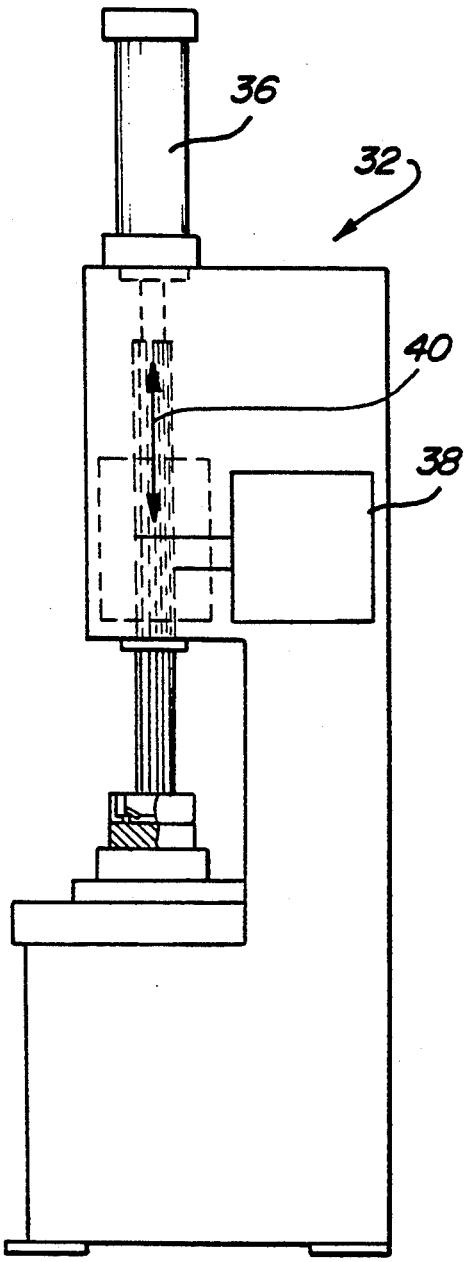

With reference now to FIGS. 5 and 6, in order to mechanically fasten the parts 12 and 14 together, the parts 12 and 14 are first assembled with the lip 16 extending through the part opening 20 and the assembled units are then placed on a work support surface 30 of a rolling machine 32 as shown in FIG. 5. The rolling machine 32 includes a roller assembly 34 which is axially aligned with the assembled parts 12 and 14. Furthermore, the roller assembly 34 is movable between an upper, illustrated in FIG. 5, and a lower position, illustrated in FIG. 6 by any conventional means, such as a cylinder 36. The rolling machine 32 also includes a motor 38, illustrated diagrammatically, to rotatably drive the roller assembly 34 about its axis 40.

With reference now especially to FIG. 3, the roller assembly 34 is there shown in greater detail and comprises an annular housing 42 having a plurality of cylindrical rollers 44 rotatably mounted to a lower end of the housing 42. Furthermore, the rollers 44 are rotatably mounted about an axes which is generally radial with respect to the axis 40 of the roller assembly 42 and thus radial with respect to the axis 15 of the assembled parts 12 and 14.

As best shown in FIG. 3, the roller assembly 42 is dimensioned so that, with the roller assembly 42 in its lower position (FIG. 6) the rollers 44 contact the outer lip 16 of the powdered metal part 12.

With reference now to FIGS. 3 and 4, in order to mechanically join the parts 12 and 14 together, the roller assembly 42 is lowered so that the rollers 44 contact the lip 16 as shown in FIG. 3. Simultaneously, the cylinder 36 (FIG. 6) exerts a downward pressure on the lip 16 as indicated by arrow 46 while the roller assembly 42 is simultaneously rotatably driven by the motor 38 (FIG. 6). In doing so, the roller assembly deforms a portion 48 (FIG. 4) of the lip 16 so that the deformed lip portion 48 overlies an edge portion 50 of the second part 14. Thus the deformed lip portion 48 entraps the edge portion 50 between the deformable portion 48 and the end 18 of the powdered metal part 12 thereby firmly mechanically attaching the parts 12 and 14 together. Additionally, if cut outs 27 are present, the rolled material is forced into the cut outs 27 which increases the torque strength of the connection between the parts 12 and 14.

With reference now to FIG. 7, the lip 16 may also include an inner beveled surface 52 adjacent its free end. This beveled surface 52 minimizes the possibility of burrs on the lip 62 following the rolling operation.

From the foregoing, it can be seen that the present invention provides a novel method and apparatus for joining powdered metal components to other components. Having described my invention, however, many modifications thereto will become apparent to those skilled in the art to which it pertains without deviation from the spirit of the invention as defined by the scope of the appended claims.

I claim:

1. An article of manufacture comprising a first part constructed of powdered metal, said first part having a lip which extends outwardly from one end of said first part, a second part having a first side, a second side and an opening extending between said sides of said second part, said opening being dimensioned so that, with said first side of said second part in abutment with said end of said first part, said lip extends through said opening and outwardly from said second side of said second part, said first and second parts being mechanically secured together by deforming said lip so that a portion of said lip overlies and entraps an edge portion of said second part between said lip portion and said end of said first part.

2. The invention as defined in claim 1 wherein said second part is constructed of steel.

3. The invention as defined in claim 1 wherein said opening comprises a slot, said lip extending through said slot.

4. The invention as defined in claim 1 wherein said second part includes a tab in said opening and said lip comprises a notch which registers with said tab.

5. The invention as defined in claim 1 wherein said lip portion is deformed by rolling said lip portion over said edge portion of said second part.

6. The invention as defined in claim 1 wherein said lip includes a bevel around an inside surface.

7. The invention as defined in claim 1 wherein said second part includes at least one cut out extending between said first and second side adjacent said lip on said first part so that said deformed lip portion enters into said cut out.

8. An article of manufacture comprising a first part constructed of powdered metal, said first part having a lip which extends outwardly from one end of said first part, a second part having a first side, a second side and an opening extending between said sides of said second part, said opening being dimensioned so that, with said first side of said second part in abutment with said end of said first part, said lip extends through said opening and outwardly from said second side of said second part, wherein a portion of said lip retrorsely overlies and entraps an edge portion of said second part between said lip portion and said end of said first part.

9. The invention as defined in claim 8 wherein said second part is constructed of steel.

10. The invention as defined in claim 8 wherein said opening comprises a slot, said lip extending through said slot.

11. The invention as defined in claim 8 wherein said second part comprises a locking tab in said opening and said lip comprises a notch which registers with said tab.

12. The invention as defined in claim 8 wherein said lip portion is deformed by rolling said lip portion over said edge portion of said second part.

13. The invention as defined in claim 8 wherein said lip includes an inner bevelled surface.

14. The invention as defined in claim 8 wherein said second part includes at least one cut out extending between said first and second side adjacent said lip on said first part so that said deformed lip portion enters into said cut out.

* * * * *